United States Patent [19]

Henn et al.

[11] Patent Number: 4,941,946

[45] Date of Patent: Jul. 17, 1990

[54] PROCESS FOR DECREASING THE TENDENCY TO FORM DEPOSITS IN PLANTS FOR EVAPORATING SPENT SULFITE LIQUORS

[75] Inventors: Manfred Henn, Mainaschaff; Klaus Begerow, Straelen; Volker Wichert, Voerde, all of Fed. Rep. of Germany

[73] Assignee: Metallgesellschaft Aktiengesellschaft, Frankfurt am Main, Fed. Rep. of Germany

[21] Appl. No.: 307,679

[22] Filed: Feb. 6, 1989

[30] Foreign Application Priority Data

Mar. 23, 1988 [DE] Fed. Rep. of Germany ..... 3809663

[51] Int. Cl.[5] ..... D21C 11/02; C23F 14/00

[52] U.S. Cl. ..... 162/36; 162/48; 159/DIG. 13; 203/7; 210/701; 210/928

[58] Field of Search ..... 162/48, 30.1, 36; 159/DIG. 13; 203/7; 210/698, 701, 928

[56] References Cited

U.S. PATENT DOCUMENTS 3,514,376 5/1970 Slutsky ..... 203/7
3,516,910 6/1970 Engman et al. ..... 159/DIG. 13
4,282,178 8/1981 Kharc ..... 159/DIG. 13
4,288,327 9/1981 Godlewski ..... 210/698

FOREIGN PATENT DOCUMENTS 53-55490 5/1978 Japan .

*Primary Examiner*—Steve Alvo
*Attorney, Agent, or Firm*—Herbert Dubno

[57] ABSTRACT

A process for decreasing the tendency to form deposits in plants for evaporating spent sulfite liquors used to produce woodpulp. In the process, the liquors are treated with polyacrylic acids having a low molecular weight. In order to prevent virtually any deposition and to increase the evaporation rate, an aqueous solution of polyacrylic acid having a low molecular weight is added to the spent sulfite liquor in an entrance stage of the multiple-effect sulfite liquor in an entrance stage of the multiple-effect evaporating system and an aqueous solution of a copolymer of sulfonated styrene and maleic anhydride or an aqueous solution of a polyacrylic acid having a low molecular weight is added to the spent sulfite liquor in at least one succeeding stage of the multiple-effect evaporating system.

15 Claims, 1 Drawing Sheet

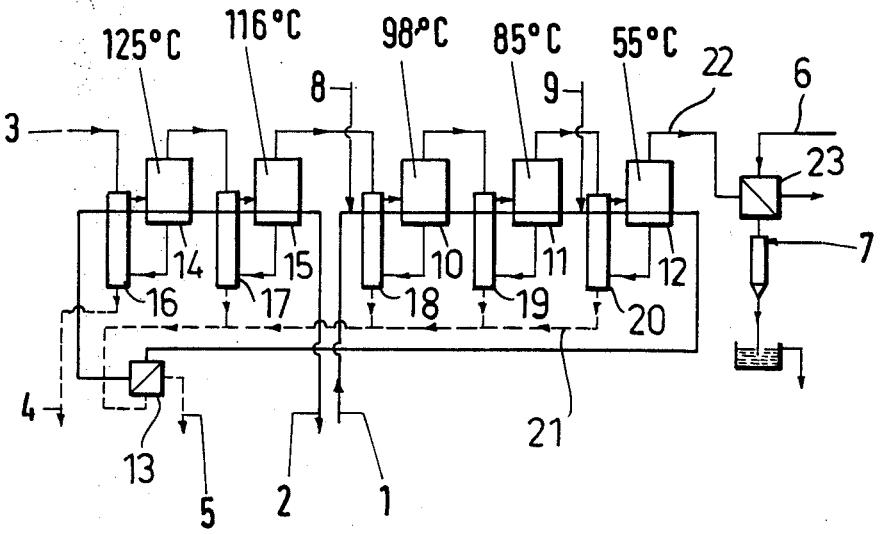
125°C
116°C
98°C
85°C
55°C
3
8
9
22
6
23
7
14
15
10
11
12
16
17
18
19
20
4
13
5
2
1
21

PROCESS FOR DECREASING THE TENDENCY TO FORM DEPOSITS IN PLANTS FOR EVAPORATING SPENT SULFITE LIQUORS

FIELD OF THE INVENTION

Our present invention relates to a process for reducing the tendency to form deposits in plants for evaporating spent sulfite liquors used to produce woodpulp, wherein the spent liquor is treated with polyacrylic acids having a low molecular weight and is optionally treated with copolymers.

BACKGROUND OF THE INVENTION

In the production of pulp by the sulfite process a feed material consisting of wood in most cases beech or fir or, in other geographic regions, consisting of a material such as bagasse, straw or stalks of corn (maize) and sunflowers, is chopped to form chips, which are treated in a digester with an acid cooking liquor which contains magnesium bisulfite and/or calcium bisulfite under a superatmospheric pressure and at temperatures up to 140° C. for several hours.

In that digestion process, the lignin is sulfonated and the hemicellulose is hydrolyzed. The resulting magnesium lignosulfonates and/or calcium lignosulfonates and the hydroxylated hemicellulose are soluble and are separated as the so-called dilute liquor from the pulp.

The dilute liquor contains about 10% solids and is neutralized and is subsequently evaporated in a multiple-effect evaporating system to form a concentrated liquor, which contains more than 50% solids and is subsequently burned. The sulfur dioxide which is released and, in the magnesium bisulfite process, the magnesia recovered are recycled to the acid cooking liquor.

In the operation of evaporating plants for evaporation dilute liquor from the sulfite process, difficulties are encountered owing to the deposition of substances which are contained in the dilute liquor.

In the processing of annual plants, these deposits consist of silicates. Where wood is used as a raw material, deposits of gypsum must usually be expected.

The formation of deposits will be small if the evaporation is effected in multiple-effect vacuum evaporators at relatively low temperatures. But, in practice, multiple-effect evaporators in a hybrid arrangement are usually operated at elevated temperatures and under superatmospheric pressure.

The tendency to crusts can be decreased by having the steam and liquor flow paths periodically interchanged in the heat exchangers so that the calcium sulfate which has been separated will be washed out by the condensate in the next following cycle of operations.

In another process, the evaporators are operated at high velocities of flow and the spent liquor is preheated to precipitate a large part of the gypsum. While these measures will reduce the tendency to form crusts, they cannot entirely prevent a formation of gypsum deposits, which will seriously disturb the operation of the plant.

For this reason, various efforts have been made to prevent the formation of such deposits or to reduce the rate at which they are formed or to change their formation so that the cost and frequency of the operations to clean the several evaporating stages during the process can be reduced.

In the process which is known from Japanese Published Patent Application No. 78/55,490 ("Chem. Abstr.", Volume 89, Ref. 152,548k) and serves to prevent a formation of crusts in plants for evaporating spent sulfite liquor, the sodium salt of a polyacrylic acid having the molecular weight 7,000 is added to the liquor in a small quantity so that the formation of crusts will be prevented for a few days.

U.S. Pat. No. 4,255,309 teaches the addition of a processing aid consisting of a polyblend of polyacrylic acid and a copolymer of maleic anhydride and vinyl methyl ether to a black liquor which has been formed in a sulfate process and is being evaporated.

In the process disclosed in U.S. Pat. No. 4,263,092, black liquor is treated in evaporating systems only with polyacrylic acid in order to avoid a deposition of sodium sulfate and sodium carbonate or of a double salt of said compounds. But there will be no deposition of gypsum in the production of sulfate pulp.

The previously known processes have not always adequately satisfied the requirements to be met in commercial practice and it is still necessary in the sulfite pulp industry to provide for a monitoring of deposits in order to maintain the evaporation capacity at a reasonable steam consumption.

In the design of evaporating systems that requirement has already been taken into account in that individual evaporating stages can be shut down and cleaned and are subsequently re-included in the process. In each plant, a predetermined schedule is usually followed in which individual stages are shut down and rinsed with so-called sour condensate for some hours. In addition, a more thorough cleaning, e.g., with nitric acid or sodium hydroxide solution, is required after a certain period of time.

OBJECTS OF THE INVENTION

It is an object of our invention to avoid the disadvantages which are encountered in the known processes, particularly in those discussed hereinbefore, and to prolong the times for which the evaporation systems can be operated.

Another object of the invention is to provide an improved process for the concentration of spent sulfite liquor wherein the tendency to form crusts is suppressed or decreased and any small crusts which may form consist of loose deposits.

SUMMARY OF THE INVENTION

These objects are attained in accordance with the invention in a process for evaporating spent sulfite liquors which have been formed in the production of woodpulp and are treated with polyacrylic acids having a low molecular weight during their evaporation.

According to our invention, an aqueous solution of polyacrylic acid having a low molecular weight is added to the spent sulfite liquor in an entrance stage of the multiple-effect evaporating system and an aqueous solution of a copolymer of sulfonated styrene and maleic anhydride or an aqueous solution of a polyacrylic acid having a low molecular weight is added to the spent sulfite liquor in at least one succeeding stage of the multiple-effect evaporating system.

It has also been found that the controlled supply of the polyacrylic acid and of the functional copolymer at only one point (at which the dilute spent sulfide liquor enters the evaporating system) will not produce tolerably satisfactory results.

The polyacrylic acids having a low molecular weight which are used in the process in accordance with the invention are commercially available products and have molecular weights between 500 and 5000, preferably between 600 and 1000.

The polyacrylic acid having a low molecular weight may continuously be supplied at a controlled rate to one or more stages of the multiple-effect evaporating system. A first stream of polyacrylic acid having a low molecular weight is supplied to or before the entrance stage for the dilute spent liquor. In a multiple-effect evaporating system having, e.g. five or six stages and producing a concentrated liquor another stream may be supplied e.g., to the third and/or to the fourth stage for treating partly concentrated liquor.

The polyacrylic acid having a low molecular weight is supplied to a given stage at a rate between 1 and 50 ppm, preferably between 5 to 15 ppm, of the rate at which the dilute liquor is supplied, and may be supplied as an aqueous solution of about 20%.

In a particularly preferred further embodiment of the process in accordance with the invention evaporating stages are downstream from the entrance stage are supplied with an aqueous solution of a copolymer of sulfonated styrene and maleic anhydride, which copolymer has a molecular weight between 1000 and 30,000, preferably between 2000 and 6000 rather than with a polyacrylic acid having a low molecular weight.

That copolymer is a product which is able to prevent a deposition not only of gypsum, but also of silicates. Such products are commercially available. Suitable products are, e.g., the products which are available under the name Versa TM TL 3 from National Starch Company, Bridgewater, N.J.

A second polymer consisting of a copolymer of 75 mole percent sulfonated styrene and 25 mole percent maleic anhydride is suitably supplied at a rate between 0.5 and 50 ppm, preferably between 1 and 5 ppm, related to the rate at which the dilute liquor is supplied. In that case, the aqueous solution of the polyacrylic acid having a low molecular weight is added to the dilute solution in the entrance stage and the aqueous solution of the copolymer is added to the partly concentrated liquor in succeeding evaporating stages. The aqueous solution of the copolymer is usually supplied as an aqueous solution having a concentration of about 10%.

A number of advantages are afforded by the process in accordance with the invention, in which a deposition may be virtually entirely inhibited so that the several evaporating stages can be kept free from deposits for a much longer time and the specific steam consumption will thus be reduced. As a result, the campaign times of the plant can be prolonged so that its availability and evaporation capacity will be increased and the specific energy consumption will be decreased.

In addition, any deposits which are formed will be very loose so that they can easily and entirely be removed by the usual rinsing with sour condensate in a much shorter time.

As a result, the volume of the rinsing liquor to be re-evaporated is decreased in favor of the throughput of dilute liquor and a stage which has been shut down can be re-connected after a shorter time and the rinsing with nitric acid or sodium hydroxide solution otherwise required in regular intervals of time may be omitted. Even old deposits formed by the conventional processing will gradually be softened and will be entrained by the rinsing fluid.

BRIEF DESCRIPTION OF THE DRAWING

The above objects, features and advantages of our invention will become more readily apparent from the following description, reference being made to the accompanying drawing the sole FIGURE of which is a flow diagram illustrating a multiple-effect vacuum-evaporating system according to the invention.

SPECIFIC DESCRIPTION

In the drawing, is shown a multiple-stage vacuum-evaporating system which comprises a plurality of heating stages 10, 11 and 12 fed in series with the dilute sulfite liquor with the partly concentrated sulfite liquor traversing a heat exchanger 13 in which it passes in indirect heat exchanging relationship with the collected condensate from a number of these stages and then in series through the evaporators 14 and 15 to be recovered as a concentrated liquor at 2. The concentrated liquor may be burned as desired or otherwise treated or disposed of.

The live steam is introduced to a first heat exchanger 16 in which the steam delivers its heat to the circulated liquor from evaporator 14 and from which spent steam is recovered at 4 for recycling to a waste heat boiler or other steam-generating unit.

The vapor phase from the evaporator 14 is passed through the heat exchanger 17 in which it heats the recycled waste liquor from the evaporator 15 and in further stages, the vapor phase from each preceding stage is delivered heat exchangers 18, 19 and 20 of the succeeding stages. The condensate from these stages is collected at 21, passed in indirect heat exchange with the partially concentrated sulfite liquor in the heat exchanger 13 previously mentioned and discharged as condensate at 5.

The temperatures at which the various stages of the evaporator are operated have been indicated in the drawing for each stage. The vapor phase is ultimately delivered at 22 to a heat exchanger 23 where it passes in indirect heat exchange with cooling water delivered at 6. The reference numeral 7 likewise represents a cooling water flow.

According to the invention, polyacrylic acid is supplied at 8 so that it is admixed with the dilute sulfite liquor before it enters the first stage of the evaporator and at one or more subsequent stages. The copolymer is supplied as represented at 9.

Specific Examples

EXAMPLE 1

In a pulp mill in which mainly beech and also some fir was processed by the magnesium bisulfite process, spent sulfite liquor at a rate of about 1000 $m^3$/day was evaporated in an evaporating system from a solids content of about 10% to a solids content of about 50%.

The stages for evaporating dilute liquor had to be rinsed with nitric acid at irregular intervals of time. The liquor sieve preceding the third evaporating stage had to be mechanically cleaned at intervals of 4 to 6 weeks. The third stage was cleared by means of a high-pressure water jet about once a year. The fourth or last stage was maintained reasonably clear by means of plastic beads which were entrained. The specific steam consumption amounted to about 370 kg steam per 1000 kg of evaporated water.

When the plant had been converted for the process in accordance with the invention, the entrance stage was supplied with a polyacrylic acid having a low molecular weight of about 600 at a rate of 7 ppm as a 24% aqueous solution. The second evaporating stage was supplied at a rate of about 3 ppm with a commercially available copolymer consisting of 25 mole percent maleic anhydride and 75 mole percent sulfonated styrene (available as "Versa TL 3" from the National Starch Company).

Solid crusts were no longer observed and the rinsing with nitric acid could be omitted The liquor sieve preceding the third stage remained clean. The sludge which was still formed in the third stage could easily be removed by two to three rinses with alkaline solution per year. In the last stage it was no longer necessary to use plastic beads, which tend to break and to clog. It was possible to maintain the last stage clear by rinsing it with sour condensate at intervals of 16 hours. The specific steam consumption slightly decreased to 350 kg steam per 10,000 kg of evaporated water.

EXAMPLE 2

In a pulp mill for processing fir by the magnesium bisulfite process, spent sulfite liquor at a rate of about 1500 $m^3$ per day was evaporated in a six-effect evaporating system from a solid contents of 12 to 18% to a concentrated liquor which contained more than 55% solids.

Each of the first four stages was rinsed in intervals of four days with sour condensate for three hours. The total rinsing time per month amounted to 90 hours. The rinsing resulted in a formation of about 450 $m^3$ condensate, which had also to be evaporated (this took about 8 hours). The specific steam consumption amounted to 210 to 220 kg steam per 1000 kg of evaporated water.

After the plant had been converted for the process in accordance with the invention, the entrance stage for the dilute solution was supplied with a polyacrylic acid having a low molecular weight of about 600 at a rate of 1.5 to 2 ppm as a 24% aqueous solution.

The same polyacrylic acid having a low molecular weight was also supplied at a rate between 2.5 and 3.8 ppm as an aqueous solution in front of the fourth evaporating stage.

Thereafter, the first four stages were rinsed only as required and the total rinsing time per month was only 10 hours. The specific steam consumption amounted to about 190 kg steam per 1000 kg of evaporated water.

EXAMPLE 3

In a pulp mill for processing coniferous wood by the calcium bisulfite process, a total of 2500 $m^3$ spent sulfite liquor was evaporated to a solids content of about 53% in two evaporating plants, which were operated in parallel and in a hybrid arrangement. In one evaporating plant, each stage had a campaign time of about 16 hours, which were followed by a rinsing time of 8 hours. In the other evaporating plant, the campaign times amounted to about 60 hours owing to a different overall mode of operation and the succeeding rinsing times amounted to 12 hours. Nitric acid for rinsing was consumed at a rate of 30,000 to 40,000 kg per month.

When the two plants had been converted for the process in accordance with the invention, the first evaporating plant was supplied in its entrance stage with 5 to 6 ppm of a polyacrylic acid having a low molecular weight of about 600 as a 24% aqueous solution and in the region which contained partly concentrated liquor was supplied with 2.5 ppm of a sulfonate group-containing polymer, as used in Example 1, as an aqueous solution. In the second evaporating plant the corresponding supplied were effected at rates of 9 to 10 ppm or 4 ppm, respectively.

It was possible to prolong the campaign times of the several stages in both plants by about 50%. It was not necessary to rinse with nitric acid, and the specific steam consumption was lower by a few percent.

We claim:

1. In a process for evaporation of spent sulfite liquor from production of wood pulp, wherein the spent sulfite liquor is passed through a multiple-effect evaporator and is progressively concentrated in an entrance evaporation stage and a succession of evaporation stages downstream from said entrance evaporation stage, the improvement wherein a tendency toward encrustation of calcium sulfate and of silicates on the evaporator is reduced by the steps of:

(a) adding polyacrylic acid which has a low molecular weight of between substantially 500 and 5000 to the spent sulfite liquor at said entrance stage;

(b) adding an aqueous solution of a copolymer of sulfonated styrene and maleic anhydride having a molecular weight between substantially 1,000 and 30,000 to the spent sulfite liquor in at least one of said succession of evaporation stages downstream from said entrance evaporation stage; and wherein said polyacrylic acid and copolymer are added in amounted effective to reduce the encrustation of calcium sulfate and silicates on the evaporator during concentration of the spent sulfite liquor.

2. The improvement defined in claim 1 wherein said polyacrylic acid has a molecular weight between substantially 600 and 1000.

3. The improvement defined in claim 1 wherein said polyacrylic acid is added in an amount of substantially 1 to 50 ppm of the spent sulfite liquor at each stage at which said low molecular weight polyacrylic acid is added.

4. The improvement defined in claim 3 wherein said polyacrylic acid is added in an amount of substantially 5 to 15 ppm of the spent sulfite liquor at each stage at which said low molecular weight polyacrylic acid is added.

5. The improvement defined in claim 1 wherein said copolymer of sulfonated styrene and maleic anhydride has a molecular weight between substantially 2,000 and 6,000.

6. The improvement defined in claim 5 wherein said copolymer of sulfonated styrene and maleic anhydride is added in an amount of substantially 0.5 to 50 ppm of the spent sulfite liquor.

7. The improvement defined in claim 6 wherein said copolymer of sulfonated styrene and maleic anhydride is added in an amount of substantially 1 to 5 ppm of the spent sulfite liquor.

8. The improvement defined in claim 1 wherein an aqueous solution of said polyacrylic acid is added in step (a) and a solution of said copolymer is supplied to at least one evaporating stage following said entrance stage.

9. The improvement defined in claim 1 wherein an aqueous solution of said polyacrylic acid is added in step (a) and an aqueous solution of said polyacrylic acid is supplied to at least one evaporating stage following said entrance stage.

10. The improvement defined in claim 1 wherein said polyacrylic acid has a molecular weight between substantially 600 and 1000 and is added in amount of substantially 5 to 15 ppm to the spent liquor at said entrance stage; and wherein said copolymer of sulfonated styrene and maleic anhydride has a molecular weight between substantially 2000 and 6000 and is added in amount of substantially 1 to 15 ppm to at least one evaporating stage following said entrance stage for evaporating a partly concentrated liquor.

11. A process for the concentration of a spent sulfite liquor from production of wood pulp, comprising the steps of:

(a) feeding the spent liquor into a multiple-effect evaporator and heating the spent sulfite liquor with steam so that the spent sulfite liquor is progressively concentrated in an entrance evaporation stage and a succession of evaporation stages downstream from said entrance evaporation stage;

(b) adding a low molecular weight polyacrylic acid having a molecular weight of substantially 500 to 6,000 to the spent sulfite liquor at said entrance stage at a rate between substantially 1 and 50 ppm of the rate at which the spent sulfite liquor is supplied thereto; and (c) adding an aqueous solution of a copolymer of sulfonated styrene and maleic anhydride having a molecular weight of substantially 1,000 to 30,000, at a rate of substantially 0.5 to 50 ppm of the rate of which the spent sulfite liquor is supplied, to the spent sulfite liquor in at lest one of said succession of evaporation stages downstream from said entrance evaporation stage, thereby reducing a tendency to encrustation of calcium sulfate and of silicates on the evaporator during concentration of said spent sulfite liquor.

12. The process defined in claim 11 wherein said copolymer of sulfonated styrene and maleic anhydride has a molecular weight between substantially 2,000 and 6,000.

13. The process defined in claim 11 wherein said copolymer of sulfonated styrene and maleic anhydride is added in amount of substantially 1 to 5 ppm of the spent sulfite liquor.

14. The process defined in claim 11 wherein said low molecular weight polyacrylic acid has a molecular weight between substantially 600 and 1000.

15. The process defined in claim 11 wherein said low molecular weight polyacrylic acid is added in amount of substantially 5 to 15 ppm of the spent sulfite liquor.

* * * * *